US005366780A

United States Patent [19]

Rapisarda

[11] Patent Number: 5,366,780

[45] Date of Patent: Nov. 22, 1994

[54] ARTICLE DECORATED WITH LIGHT EMITTING DIODES USING STRANDED CONDUCTIVE WIRE

[76] Inventor: Carmen Rapisarda, 1715 Edgecomb, Covina, Calif. 91724

[21] Appl. No.: 610,686

[22] Filed: Nov. 8, 1990

Related U.S. Application Data

[63] Continuation-in-part of Ser. No. 437,193, Nov. 16, 1989, Pat. No. 5,019,438.

[51] Int. Cl.[5] ..... F21L 15/08; F21V 21/00

[52] U.S. Cl. ..... 428/102; 428/137; 428/917; 362/103; 362/108; 362/184; 362/249; 362/252; 362/800; 362/806

[58] Field of Search ..... 362/103, 108, 800, 806, 362/252, 249, 184; 428/102, 137, 917

[56] References Cited

U.S. PATENT DOCUMENTS

| | | | |
|---|---|---|---|
| 1,375,540 | 4/1921 | Smith | 362/103 |
| 2,430,607 | 11/1947 | Gaskouitz | 362/103 |
| 2,962,580 | 11/1960 | Jones | 362/108 |
| 3,083,295 | 3/1963 | Baker | 362/108 |
| 4,234,907 | 11/1980 | Daniel | 362/806 |
| 4,480,293 | 10/1984 | Wells | 362/108 |
| 4,602,191 | 7/1986 | Davila | 362/800 |
| 4,709,307 | 11/1987 | Branom | 362/800 |
| 4,727,603 | 3/1988 | Howard | 362/103 |
| 4,774,642 | 9/1988 | Janko et al. | 362/806 |
| 4,823,240 | 4/1989 | Shenker | 362/108 |
| 5,019,438 | 5/1991 | Rapisarda | 428/102 |

*Primary Examiner*—George F. Lesmes
*Assistant Examiner*—Terrel Morris
*Attorney, Agent, or Firm*—Edgar W. Averill, Jr.

[57] ABSTRACT

An article decorated with light emitting diodes which uses stranded conductive wire. Two lengths of thin, flexible stranded conductive wire are sewn to a piece of material, and a light emitting diode has one of its conductors connected to one of the conductive wires and the other lead connected to the second wire. The wire is sewn by placing the thin, stranded conductive wire onto the bobbin of a sewing machine which then sews the conductor much in the same way it would sew a conventional thread. The result is an attractively and spectacularly decorated piece of material when the conductors are energized to light the light emitting diodes.

4 Claims, 1 Drawing Sheet

FIG. 1.
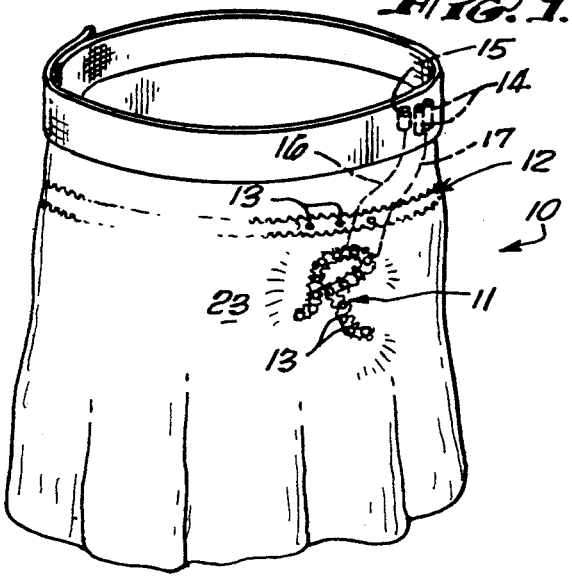
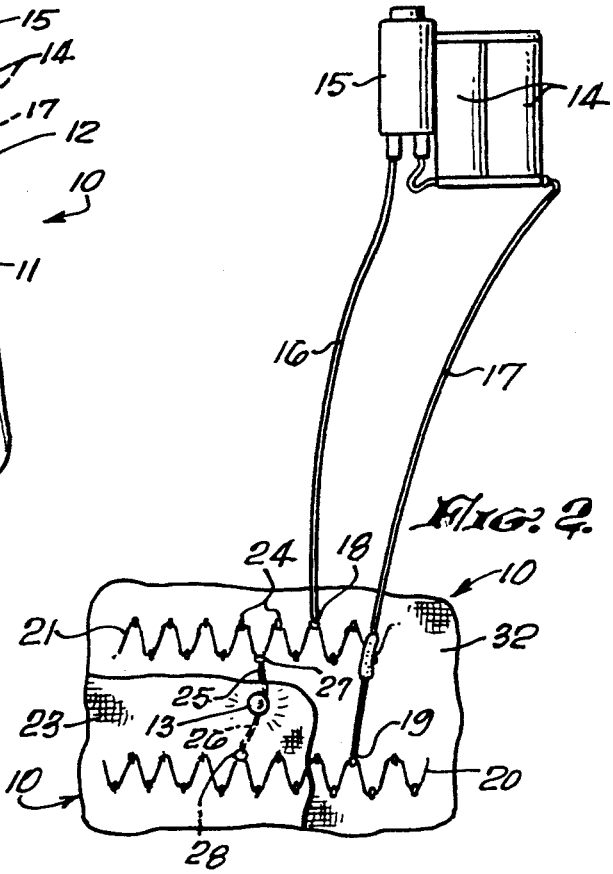
FIG. 2.
FIG. 3.
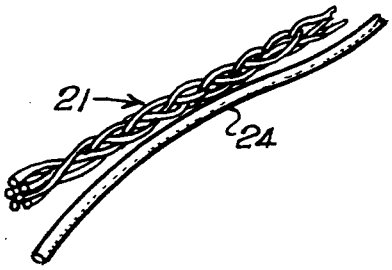
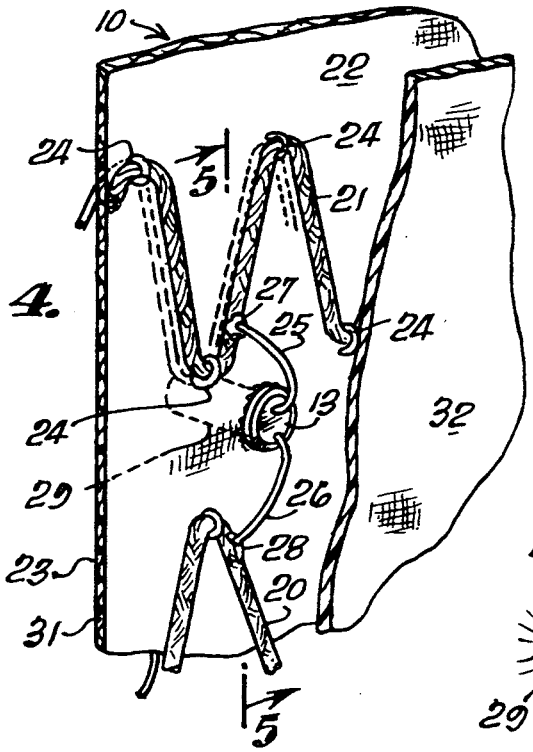
FIG. 4.
FIG. 5.
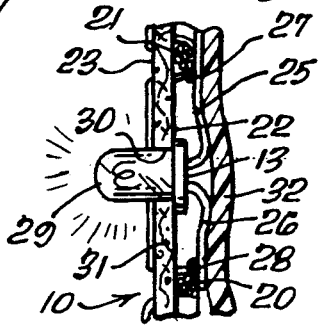
FIG. 6.
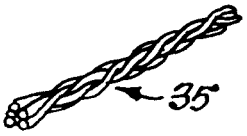

ARTICLE DECORATED WITH LIGHT EMITTING DIODES USING STRANDED CONDUCTIVE WIRE

CROSS-REFERENCES TO RELATED APPLICATIONS

The present application is a continuation-in-part of applicant's pending patent entitled LEATHER ARTICLE DECORATED WITH LIGHT EMITTING DIODES filed Nov. 16, 1989, Ser. No. 07/437,193, now U.S. Pat. No. 5,019,438.

BACKGROUND OF THE INVENTION

The field of the invention is clothing, and the invention relates more particularly to clothing of the type used by entertainers. Such clothing is often decorated with sequins and other brightly colored or sparkling articles. As set forth in applicant's co-pending application referred to above, an especially spectacular effect is obtained when light emitting diodes are energized to provide bright red, green or yellow lights. These can be sewn in a pattern and flashed on and off to provide a particularly attractive appearance.

It was believed that it was necessary to sew a relatively heavy, flat braided wire to the reverse side of the material being decorated in order to provide sufficient amperage to the LEDs. The resulting decorated article was then somewhat reduced in flexibility because of the thickness of the conductive lengths.

SUMMARY OF THE INVENTION

It is an object of the present invention to provide an article decorated with light emitting diodes which utilizes very thin, flexible conductors.

The present invention is for an article decorated with light emitting diodes comprising an area of material of the type used to make clothing having an outer surface and an inner surface. First and second lengths of thin, flexible, stranded conductive wire are sewn against the inner surface of the area of material to be decorated. These wires are spaced from one another so that they do not touch. Next, a plurality of holes are formed in the material, and light emitting diodes are inserted through the holes from the back so that the LED protrudes through the surface and one of the leads of the LED contact one of the wires, and the other lead contacts the other wire, and the leads are soldered or otherwise conductively affixed to the wire. A battery and, preferably, a switch, are then also connected to the wires so that the LEDs may be turned on and off by turning on and off a switch. The process of placing the wires on the backside of the material is also claimed and comprises winding a length of thin, flexible stranded conductive wire on the bobbin of a sewing machine and then sewing a length of sewn thread onto the material using a conventional nonconductive thread on the spool of thread of the sewing machine. The result is an especially flexible and inexpensive garment since conventional sewing machines may be used not only to place a conductor but also to provide an attractive stitching on the face of the garment.

BRIEF DESCRIPTION OF THE DRAWINGS

FIG. 1 is a perspective view of a garment decorated with light emitting diodes energized by thin, flexible, conductive wires.

FIG. 2 is a diagrammatic view showing the battery and switch useful with the article of FIG. 1.

FIG. 3 is an enlarged perspective view of the conductive and nonconductive threads used with the garment and process of the present invention.

FIG. 4 is a perspective view, partially cut away showing the inner surface of the decorated garment.

FIG. 5 is a cross-sectional view taken along 5—5 of FIG. 4.

FIG. 6 is an enlarged perspective view of the thin, flexible, stranded conductive thread of the present invention.

DESCRIPTION OF THE PREFERRED EMBODIMENTS

A decorative article, namely, a skirt 10 is shown in perspective view in FIG. 1 and includes a decorated area 11, which is generally in the form of letter, and a decorative band 12, each of which includes a plurality of light emitting diodes 13. The batteries 14 and switch 15 are also shown in FIG. 1 and in an enlarged view in FIG. 2. The switch is preferably kept in an inconspicuous area of the garment so that it may be turned on and off but is not visible from the exterior of the garment.

As shown in FIG. 2, the batteries 14 and switch 15 energize a pair of flexible, conductive wires 16 and 17 which are soldered at 18 and 19 to two lengths of conductive thread 20 and 21. These threads and the soldering are positioned on the inner surface 22 of the material which makes up skirt 10. The outer surface of the skirt is indicated by reference character 23. The thin, flexible, stranded conductive thread or wire is shown in perspective view in FIG. 3 and indicated by reference character 21. In FIG. 3, it can be seen to be a braided conductor, and such thin conductors are used in conjunction with various electronic devices such as head sets where a combination of flexibility and conductivity is important. It has been found that this conductive wire 21 can be placed on the bobbin of a good quality industrial type of sewing machine and used in the same manner that conventional thread is used. The result is shown in FIG. 4 where the wire 21 is held to the inside surface 22 of skirt 10 by a plurality of loops 24. The light emitting diode (LED) 13 can be seen to have a pair of leads 25 and 26 which are soldered at 27 and 28 to wires 21 and 20, respectively. The bulb portion 29 of LED 13 is shown best in FIG. 5 and can be seen to extend through a hole 30 in the material 31 from which skirt 10 is made. This provides a very bright light from the exterior of the article.

It is preferable to cover the conductive wires and leads of the LED with a layer of insulative material 32 for comfort as well as to prevent any short circuits or damage to the soldered connections.

While leather is the most commonly decorated material which is anticipated, it is also contemplated that vinyl, denim and other articles can also be so decorated. While the conductors are shown as braided conductors, they could, of course, be stranded and twisted rather than braided with the important consideration being flexibility and ability to bend without breaking.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An article decorated with light emitting diodes comprising:

an area of material of the type used to make clothing having an outer surface and an inner surface;

a first length of thin, flexible, stranded conductive wire sewn against the inner surface of said area of material;

a second length of thin, flexible, stranded conductive wire sewn against the inner surface of said area of material, said second length being sewn spaced from said first length;

a plurality of holes formed in said area of material between said first and second lengths;

a plurality of light emitting diodes, each diode having a lens portion, and a first and a second lead extending therefrom and positioned on the back of said area of material, each first lead being electrically connected to said first length of thin, flexible, stranded conductive wire, and each second lead being electrically connected to said second length of thin, flexible, stranded conductive wire, and said lens portion of each light emitting diode extending through one of said plurality of holes in said area of material; and battery means connected through switch means to said first and second lengths whereby when said switch means is closed, the light emitting diodes are energized.

2. The article of claim 1 wherein the first and second lengths of thin, flexible, stranded conductive wire each form a closed loop.

3. The article of claim 1 further including a flexible, insulative layer affixed over said two lengths of thin, flexible, stranded conductive wires.

4. The article of claim 1 wherein said battery means and said switch means are connected to said first and second lengths of thin, flexible, stranded conductive wires through a length of flexible conductor so that the resulting circuit may be energized from a remote location.

* * * * *